US005403468A

United States Patent [19]

Nakakoji et al.

[11] Patent Number: 5,403,468

[45] Date of Patent: Apr. 4, 1995

[54] PROCESS FOR THE MANUFACTURE OF TINPLATE USING A FUSED TIN CHLORIDE ELECTROPLATING BATH

[75] Inventors: Hisatada Nakakoji; Seiji Nakajima; Shuji Gomi; Nobuyuki Morito, all of Chiba, Japan

[73] Assignee: Kawasaki Steel Corporation, Japan

[21] Appl. No.: 850,454

[22] Filed: Mar. 10, 1992

[30] Foreign Application Priority Data

Mar. 13, 1991 [JP] Japan ..... 3-048313
May 16, 1991 [JP] Japan ..... 3-111638
Nov. 20, 1991 [JP] Japan ..... 3-304614

[51] Int. Cl.[6] ..... C25D 3/66; C25D 7/06

[52] U.S. Cl. ..... 205/148; 205/140; 205/206; 205/209; 205/230

[58] Field of Search ..... 205/230, 231, 232, 140, 205/154, 148, 209, 206

[56] References Cited

U.S. PATENT DOCUMENTS 4,966,659 10/1990 Seto et al. ..... 204/28

FOREIGN PATENT DOCUMENTS 47-4121 2/1972 Japan .
57-39313 8/1978 Japan .
109486 1/1958 U.S.S.R. .

*Primary Examiner*—John Niebling
*Assistant Examiner*—William T. Leader
*Attorney, Agent, or Firm*—Bierman and Muserlian

[57] ABSTRACT

A process for the manufacture of tinplates comprising electroplating a substrate in a fused-chloride tin plating bath at a temperature of about 150° to 350° C., a current density of about 100 to 500 A/dm$^2$ in an atmosphere of a non-oxidizing gas. This process may be converted to a process for the manufacture of reflow type tinplates by only changing the bath temperature, and vice versa. For the manufacture of no-reflow type tinplates, the bath is kept at 150° to 232° C., while for the manufacture of reflow type tinplates, the bath is kept at 233° to 350° C. In these cases, the bath includes $SnCl_2$ and at least one member selected from the group consisting of KCl, NaCl, LiCl and $AlCl_3$, and may preferably be operated while flowing the bath at a flow rate of about 0.1 m/sec higher. There is provided equipment for the manufacture of tin-plated steel strip comprising a pretreating apparatus for cold rolling steel strip, an annealing apparatus, a skin pass rolling apparatus, a fused-salt tin-electroplating apparatus with the above bath including chlorides, and an aftertreating apparatus, these apparatus being continuously integrated into the equipment by use of a fused-salt bath.

4 Claims, 3 Drawing Sheets

1
2
3
4
5
8
9
10
12

PROCESS FOR THE MANUFACTURE OF TINPLATE USING A FUSED TIN CHLORIDE ELECTROPLATING BATH

BACKGROUND OF THE INVENTION

1. Field of the Invention

This invention relates to a process for the manufacture of tinplates. More particularly, this invention relates to a process to the manufacture of tinplates at a high speed.

Furthermore, this invention relates to a manufacturing equipment of tin-plated steel strip.

2. Description of the Prior Art

Tin plated steel sheets called tinplates have been well known and are widely used for the manufacture of tableware, containers, decorations, and the like. In recent years, they are extensively used for the manufacture of soldered wiring parts of electrical appliances.

Until now, a hot dipping process or an electroplating process has been used as a tin plating process.

The hot dipping process is suitable for the tin plating of a substrate which requires a large amount of coating, and the substrate is plated by immersion in a bath containing fused metallic tin.

The electroplating process is suitable for the tin plating of a substrate which requires a relatively small amount of coating thereon, and the substrate is electroplated as a cathode in an aqueous electroplating bath containing sodium stannate for Alkali Process, stannous sulfate and phenolsulfonic acid for Ferrostan Process, and stannous chloride, sodium chloride and sodium fluoride for Halogen Process.

The tinplate is manufactured in a large scale by the electroplating process because the amount of coating is a relatively small.

With the widespread use of automatic vending machines, the production volume of tinplates for use in the making of seamless DI cans for canned drinks is increasing rapidly in recent years. Accordingly, there is a need for developing a high-speed tinplate manufacturing process.

In the conventional hot dipping process, it is impossible to further increase the passing speed of the steel sheet in the bath containing fused metallic tin having a specific gravity of 7.28, and also impossible to perform the plating at high speed without impairment of the uniform coating of tin, because the amount of coatings is controlled by wringer roll governing.

At present, tinplates are manufactured by an electroplating process. In this case, the usable upper limit of current density is low, and limited to about 10 A/dm$^2$ for Alkali Process, about 30 A/dm$^2$ for Ferrostan Process, and about 50 A/dm$^2$ for Halogen Process. Thus, when a high-speed manufacturing process is desired, it is necessary to install a number of plating baths additionally. That is expensive. Therefore, the maximum plating rate is limited to about 600 m/min or lower in the conventional plating facilities.

In order to achieve a high-speed manufacture of tinplates, it is necessary to develop a tin electroplating process at high current densities.

As the tin plating process which may operate the bath at a current density of 50 A/dm$^2$ or higher, a fused-salt tin plating bath has been proposed.

Soviet Patent No. 109486 discloses a fused-salt tin plating tin plating bath containing $SnCl_2$-KCl, $SnCl_2$-KCl-$ZnCl_2$, or $SnCl_2$-$ZnCl_2$, which may operate at 200° to 500° C. and a current density of 50 to 100 A/dm$^2$. However, the plating rate is only about twice as fast as it is in the conventional Halogen Bath and still insufficient to perform the high-speed plating.

Generally, tin-plated steel sheets are manufactured by discontinuous treatment of cold rolling steel sheets in the following individual apparatus and order named:

(a) continuous pretreating and annealing apparatus shown in FIG. 3-(*a*)

(b) skin pass rolling apparatus shown in FIG. 3-(*b*)

(c) tin-electroplating and aftertreating apparatus shown in FIG. 3-(*c*)

In recent years, there is an instance wherein the continuous annealing apparatus is integrated with the skin pass rolling apparatus into a new equipment for reducing the cost. In this case, there is substantially no difference in the proceeding speed of the steel sheet to be treated through the processes.

The cost will be further reduced, provided that the tin-electroplating apparatus can be further combined with the equipment. However, it is difficult to do so, because the proceeding speed of steel sheet in the plating process is too low in comparison with the speed of the sheet treated in the annealing or skin pass rolling process.

In the tin-electroplating process heretofore in use, the steel sheet is plated as a cathode in an aqueous tin-plating plating bath containing sodium stannate for Alkali Process, stannous sulfate and phenolsulfonic acid for Ferrostan Process, or stannous chloride, sodium chloride and sodium fluoride for Halogen Process [A Handbook of Iron and Steel, the 3rd. edition, vol. VI, 403].

In these processes, the usable current density has its upper limit of about 50 A/dm$^2$ or lower, because of the low electrical conductivity of the aqueous plating bath and the burnt deposit of tin. Moreover, the proceeding speed of the sheet in the conventional plating bath has its upper limit of about 300 to 600 m/min. The speed is too low and cannot compare with the proceeding speed of about 600 to 900 m/min of the steel sheet in the continuous annealing or skin pass rolling process.

The tin-electroplating operation at a proceeding speed of about 600 to 900 m/min is impossible to realize because such a high-speed operation requires considerable number of plating baths, a large plant area and a larger construction cost unpreferably.

The object of the invention is to provide a process for the manufacture of tinplates including both reflow type and no-reflow type tinplates at high speed and high current densities.

Another object of the present invention is to provide a manufacturing equipment of tin-electroplated steel strip by which the manufacturing cost may be steeply reduced.

SUMMARY OF THE INVENTION

According to a first aspect of the invention, there is provided a tinplate manufacturing process wherein the plating may be carried out at a temperature of 150° to 350° C., and a current density of 100 to 500 A/dm$^2$ in an atmosphere of a non-oxidizing gas in the bath containing a fused salt of chlorides.

This process can be used as two different-type plating processes by only making a change in the bath temperature, one process being for the manufacture of reflow type, another being for the manufacture of no-reflow type tinplates. When no-reflow type tinplates are manufactured, the electroplating step is carried out with the bath at a temperature of 150° to 232° C. When reflow type tinplates are manufactured, the electroplating step is carried out with the bath at a temperature of 233° to 350° C.

At the manufacture of tinplates, it is preferable to use a bath including $SnCl_2$ and at least one member selected from the group consisting of KCl, NaCl, LiCl and $AlCl_3$, among which the bath for no-reflow type tinplate is preferably including 15 to 55% by mole of $SnCl_2$, 30 to 70% by mole of $AlCl_3$, and 15 to 40% mole of NaCl or LiCl.

The electroplating is preferably effected while flowing the bath at a flow rate of 0.1 m/sec or higher.

Furthermore, the substrate may be preheated in advance of the plating to the bath temperature or higher in an atmosphere of a non-oxidizing gas. Then, a surface treated substrate may be used.

According to a second aspect of the invention, there is provided equipment for the manufacture of tin-plated steel strip comprising a pretreating apparatus cold rolling steel strip, an annealing apparatus, a skin pass rolling apparatus, a fused-salt tin-electroplating apparatus, and an aftertreating apparatus, these apparatus being continuously integrated into the equipment in the order named and in series in the proceeding direction of the steel strip.

In this case, it is preferable that the annealing, skin pass rolling, and fused-salt electroplating apparatus are connected in an atmosphere of a non-oxidizing gas.

According to a third aspect of the invention, there is provided equipment for the manufacture of tin-plated steel strip comprising a pretreating apparatus for cold rolling steel strip, an annealing apparatus, a fused-salt tin-electroplating apparatus, a skin pass rolling apparatus, and an aftertreating apparatus, these apparatus being continuously integrated into the equipment in the order named and in series in the proceeding direction of the steel strip.

In this case, it is preferable that the annealing and fused-salt electroplating apparatus are connected in an atmosphere of a non-oxidizing gas.

In these cases, it is preferable that the fused-salt tin plating apparatus includes means for flowing the fused-salt in the bath, means for electroplating at a current density of up to 500 $A/dm^2$, and means for maintaining the bath at a predetermined temperature ranging from 150° C. to 350° C.

Figure 1:
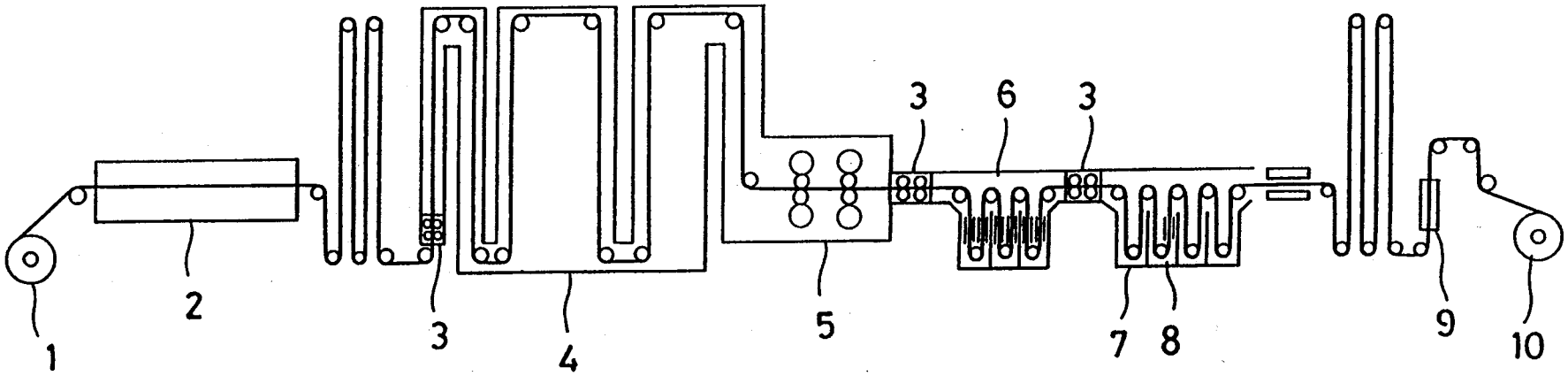
FIG. 1 is an example of equipment for the manufacture of tin-plated steel strip according to the present invention.

(a) continuous pretreating and annealing apparatus
(b) skin pass rolling apparatus
(c) tin-electroplating and aftertreating apparatus

DETAILED DESCRIPTION OF THE INVENTION

Although the rate of plating increases with an increase in the current density, the usable current density has its upper limit (critical current density) in a conventional aqueous plating bath.

In the conventional bath, the maximum concentration of metallic ions present in the bath depends on the solubility of the metallic salt employed. Therefore, even when the current density is further increased, the diffusion of the metallic ions is reached to its limit, resulting in an unsatisfactory coatings. Further, the electrical conductivity of a conventional electroplating bath is so low that it is difficult to further increase the current density without a great increase in the plating voltage. Such additional electrical installations are a burden economically.

The present inventors have extensively researched to develop a plating bath having a high electric conductivity for the high-speed electroplating, and unexpectedly found that conventional aqueous electroplating baths are unsuitable for the purpose due to lower concentration of Sn ions in the bath, and a fused-salt bath containing a fused tin salt itself is suitable for the high-speed tin electroplating.

In addition, the inventors have founds that it is also necessary to flow the fused-salt at above a specific speed simultaneously with employment of the aforedescribed fused-salt bath of the present invention in order to realize the high-speed plating.

Among fused salts, a chloride is most preferred for the electroplating because the chloride has a relatively low melting point, and is easy to handle. The plating composition comprises $SnCl_2$ as a source of Sn ions, and KCl, NaCl, LiCl, $AlCl_3$, or mixtures thereof as a melting point depression agent or an auxiliary agent for assisting conductivity. Any proportion may be employed.

Now, the inventors have found that a specific fused-salt tin plating bath is especially suitable for use for manufacture of no-reflow tinplates in the tin electroplating process at high current densities. The bath composition consists essentially of 3 components, $SnCl_2$-$AlCl_3$-NaCl or LiCl.

Regarding the manufacture of no-reflow tinplates, the Japanese Patent Application Publication No. 47-4121 discloses simply a tin plating process at a very low current density, and it is unpredictable from reading of the description that such a high-speed tin plating process at high current densities for the manufacture of tinplates may be completed by using a fused-salt bath which is not disclosed in said Japanese Patent Application Publication No. 47-4121.

The suitable bath composition of the present invention comprises an amount of 15 to 55% by mole of $SnCl_2$, 30 to 70% by mole of $AlCl_3$, and 15 to 40% by mole of NaCl or LiCl for no-reflow tinplate.

When the amount of $SnCl_2$, a source of Sn ions, is less than 15% by mole percent, the properties of the tin coatings are impaired because of an insufficient supply of tin ions.

When the amount of $SnCl_2$ is more than 55% by mole, the plating voltage increases unpreferably for the high current density plating.

When the amount of $AlCl_3$, a melting point depression agent, is less than 30% by mole, the melting point of the bath becomes too high, the flowability of the bath is impaired, and the plating voltage becomes high unpreferably for the high current density plating.

When the amount of $AlCl_3$ is more than 70% by mole, the conductivity of the bath is lowered because degradation product such as $Al_2Cl_7^{2-}$ complex ions increases in the bath, and the plating voltage increases unpreferably for the high-speed tin plating operation at high current densities.

When the amount of NaCl or LiCl, an auxiliary agent for assisting conductivity, is less than 15% by mole, the bath conductivity is insufficient for the high-speed tin plating operation.

When the amount of NaCl or LiCl is more than 40% by mole, the melting point of the bath is raised, the flowability of bath impairs, and the plating voltage increases unpreferably.

The bath of the present invention can be satisfactorily operated at a temperature of 150° to 350° C. When the temperature is above 232° C., so-called reflow type tinplates can be obtained. On the other hand, when the temperature is below 232° C., so-called no-reflow type tinplates can be obtained for the reason that the coatings in a no-reflow state, i.e. in a solid state forms on the surface of the sheet at 232° C. or lower.

In the present invention, it is possible to convert the bath for the manufacture of no-reflow type tinplates to a new bath of reflow type tinplates by only changing the bath temperature, and vice versa. When the bath temperature is below 150° C., the fused-salt solidifies, and when the bath temperature is above 350° C., the alloying velocity of Sn with Fe increases rapidly and the Sn-Fe alloy reaches the surface of the coating, resulting in a dull and grayish black coating in appearance and the salt fumes unpreferably.

The preferred plating current density is in a range of from 100 to 500 A/dm$^2$. When the current density is within the range, it is possible to conduct the high-speed operation as shown in Table 1, wherein a tinplate (#50) having a tin coatings in an amount of 5.6 g/m$^2$ may be obtained at a plating rate of 600 m/min or higher by use of 10 baths or less. When the current density is 500 A/dm$^2$ or higher, the bath temperature is raised by resistance heating unpreferably.

TABLE 1

Current Density and the Number of Tin Plating Baths (calculated)

| Proceeding Speed of Substrate (600 m/min) | | Proceeding Speed of Substrate (800 m/min) | |
|---|---|---|---|
| Current Density (A/dm$^2$) | Number of Baths | Current Density (A/dm$^2$) | Number of Baths |
| 20 | 33 | 20 | 44 |
| 50 | 13 | 50 | 18 |
| 100 | 7 | 100 | 9 |
| 200 | 4 | 200 | 5 |
| 300 | 3 | 300 | 3 |
| 400 | 2 | 400 | 3 |
| 500 | 2 | 500 | 2 |

Note:
(a) The amount of coating is set up at 5.6 g/m$^2$ (#50).
(b) Assumed plating efficiency is 70%.
(c) Assumed number of electrodes to be housed is 2 pairs (1 m in length × 2) in a plating bath.

In addition to the above-described conditions, it is necessary to flow the fused-salt of the present invention at a speed of 0.1 m/sec or higher. Any direction of the flow of the fused-salt relative to the sheet may be employed, but the flow of the fused-salt in the same direction of the sheet is preferred. In the flow of the salt in an exact opposite direction of the sheet, the aid of a heavy-duty pump is necessary to flow the salt. When the flow speed of the fused-salt is 0.1 m/sec or lower, a higher voltage is necessary to operate the bath at 100 A/dm$^2$ or higher, because of an unpreferable low travel speed of Sn ions.

In the present invention, it is preferred to conduct the tin plating operation in an atmosphere of a non-oxidizing gas such as nitrogen, a mixed gas of nitrogen with hydrogen, or the like which is charged in the plating vessel, because the bath is deteriorated in the presence of air due to an accumulation of tin oxychloride in the bath which is produced by oxidation of $Sn^{+2}$ ions to $Sn^{+4}$ ions.

It also is preferred to preheat the substrate to the bath temperature or higher in advance of the plating. When the substrate having a temperature of lower than the bath temperature is dipped into the bath, the fused-salt solidifies on the surface of the steel sheet, or a temperature gradient occurs in the bath, resulting in an uneven coatings unpreferably.

Generally, the substrate is preheated to the bath temperature or to a temperature higher than the bath temperature by 5° to 30° C.

The preheating may be conveniently carried out by a conventional method, apparatus, or means such as electric heating, induction heating, infrared heating, or radiation heating.

The resulting tin electroplated steel sheet is then rinsed with water (pulsed water shot is preferred).

Examples of the substrate include steel sheets, copper sheets, steel wires, copper wires and the like.

Surface-treated steel sheets are preferred to be plated in the process of the present invention.

Examples of the surface-treating process include a Ni or Cr plating process, Ni-Cr alloy plating process, and a diffusion process.

Equipment for the manufacture of tin-plated steel strip will now be explained with reference to the accompanying drawings.

In the case of an integrated operation of the whole process including the pretreating, annealing, skin pass rolling, fused-salt tin-electroplating, and aftertreating process, it is necessary to conduct the tin-electroplating process at high current densities.

As stated, the present inventors have found that a fused-salt tin-electroplating bath can be operated at a current density higher than 100 A/dm$^2$, and the integrated operation of the whole process can be continuously conducted by use of the bath.

Among the fused-salts, a chloride is most preferred for use in the electroplating bath because of its low melting point, for example, 136° C. for the bath comprising 70% by weight of $SnCl_2$ and 30% by weight of $AlCl_3$, and easiness to handle.

The fused-salt plating bath used in the present invention contains $SnCl_2$, a source of Sn ions, and a compound selected from the group consisting of KCl, NaCl, LiCl, $AlCl_3$, and mixtures thereof as a melting point depression agent or auxiliary agent for assisting conductivity. Any proportion of the chloride in the fused-salt bath may be employed.

The bath used in the present invention can be satisfactorily operated at a temperature of 150° to 350° C. When the bath temperature is above 232° C., so-called reflow type tin-plated steel sheets can be obtained. On the other hand, when the bath temperature is below 232° C., so-called no-reflow type tin-plated steel sheets can be obtained for the reason that the coating in a no-reflow state forms on the surface of the steel sheet at a bath temperature of 232° C. or lower. When the bath temperature is below 150° C., the fused-salt solidifies, and when the bath temperature is above 350° C., the alloying velocity of Sn with Fe increases rapidly and the Sn-Fe alloy reaches the surface of the coating, resulting in a coating with a dull and grayish black appearance and the salt fumes unpreferably.

The preferred current density is in a range of from 100 to 500 A/dm$^2$. When the current density is within the range, it is possible to conduct the high-speed operation as shown in Table 1, wherein a tinplate (#50) having a tin coating in an amount of 5.6 g/m$^2$ may be obtained by use of 10 baths or less. When the current density is 500 A/dm$^2$ or higher, the bath temperature is raised by resistance heating unpreferably.

In the present invention, it is preferred to conduct the tin-plating operation in an atmosphere of a non-oxidizing gas, because the bath is deteriorated in the presence of air due to an accumulation of tin oxychloride in the bath which is produced by oxidation of $Sn^{+2}$ ions to $Sn^{+4}$ ions.

It also is preferred to preheat the cold rolling steel sheet to the bath temperature or higher in advance of the plating. When the steel strip having a temperature of lower than the bath temperature is dipped into the bath, the fused-salt solidifies on the surface of the steel strip, resulting in an uneven coatings unpreferably. It is also preferred to conduct the preheating of the steel strip in an atmosphere of a non-oxidizing gas because the plating is prevented by iron-oxide formation on the surface of the steel strip when preheated in the presence of air.

By integrating the whole processes in series into an equipment, the above-described problems can be easily solved. That is, it is possible to obtain an even tin coating while preventing the oxidation of $Sn^{+2}$ by a process wherein the steel strip heated in the annealing furnace at a temperature higher than the bath temperature is introduced into the tin-plating bath after skin pass rolling in an atmosphere of a non-oxidizing gas, said atmosphere being of the same gas used for sealing in the annealing process. The atmosphere of a non-oxidizing gas itself used in the annealing process may be used simultaneously in the integrated process of the skin pass rolling and fused-salt plating process.

The annealing, skin pass rolling, and fused-salt tin-plating apparatus may be individually sealed by a sealing device and operated in a different atmosphere of a non-oxidizing gas.

The tin-electroplated steel strip is rinsed by water (pulsed water shot is preferred) immediately after the electroplating, followed by a conventional chromate treatment and oil coating.

The pretreating and annealing apparatus of the type for conventional continuous annealing process may be employed. Examples of the pretreating process include surface-cleaning, pickling, Ni or Cr-preplating process, a combination thereof, and the like.

Any skin pass rolling process such as roller-type or tension leveller-type may be employed, provided that the process is a dry-type process so that the skin pass rolling may be conducted in an atmosphere of a non-oxidizing gas with no use of a rolling oil. The skin pass rolling may be conducted after the completion of the plating as the need arises. In this case, a rolling oil may be employed, and there is no necessity for conducting the rolling in an atmosphere of a non-oxidizing gas.

As stated above, the bath including $SnCl_2$ as $Sn^{2+}$ ion source and other chlorides such as KCl, NaCl, LiCl, $AlCl_3$, etc. may be flowed at a flow rate of 0.1 m/sec or higher by a suitable means such as an agitator, a pump, or the like.

Equipment of the present invention may be used either for the manufacture of no-reflow type tinplates or for the manufacture of reflow type tinplates only by changing the operating temperature, so that it is preferable to install means for keeping the operating temperature of the bath at a predetermined or preset temperature for the manufacture of either no-reflow or reflow type tinplates.

EXAMPLE

The following Examples will illustrate the present invention, which by no means limits the invention.

EXAMPLE 1

After degreasing and pickling, a steel sheet was heated in an atmosphere of the following non-oxidizing gas (a) or (b), and then electroplated in the following fused-salt tin electroplating bath (A), (B), (C) or (D) in an atmosphere of the same non-oxidizing gas to prepare a tinplate sample. The bath (E) and (F) are conventional aqueous tin plating baths. The plating conditions are given in Table 2.

| | | |
|---|---|---|
| Non-oxidizing gas (a): 95% $N_2$ - 5% $H_2$ | | |
| Non-oxidizing gas (b): 100% $N_2$ | | |
| (A): | $SnCl_2$ | 62% by mole |
| | KCl | 38% by mole |
| (B): | $SnCl_2$ | 68% by mole |
| | NaCl | 32% by mole |
| (C): | $SnCl_2$ | 62% by mole |
| | KCl | 38% by mole |
| | LiCl | 14% by mole |
| (D): | $SnCl_2$ | 65% by mole |
| | $AlCl_3$ | 35% by mole |
| (E): | Halogen Bath | |
| | $SnCl_2$ | 50 g/L |
| | NaF | 55 g/L |
| | $NaHF_2$ | 15 g/L |
| | NaCl | 55 g/L |
| | A brightener | a proper quantity |
| (F): | Ferrostan Bath | |
| | $SnSO_4$ | 55 g/L |
| | Phenolsulfonic acid (80% solution) | 50 ml/L |
| | A brightener | a proper quantity |

TABLE 2

| | Plating Conditions and Properties of the Tinplate | | | | | | | | |
|---|---|---|---|---|---|---|---|---|---|
| | Steel Sheet Preheating | | Sn Electroplating Conditions | | | | | | |
| | Atmosphere | Temp. (°C.) | Bath | Atmosphere | Bath Temp. (°C.) | Current Density (A/dm$^2$) | Flow rate (m/sec) | Appearance | Note |
| Example | | | | | | | | | |
| 1 | (a) | 200 | (A) | (b) | 200 | 200 | 0.5 | good | N |
| 2 | (b) | 210 | (B) | (b) | 190 | 150 | 0.2 | good | N |
| 3 | (a) | 220 | (C) | (a) | 215 | 250 | 0.8 | good | N |
| 4 | (a) | 250 | (A) | (b) | 250 | 300 | 0.5 | good | R |
| 5 | (b) | 330 | (B) | (b) | 330 | 450 | 0.7 | good | R |
| 6 | (a) | 285 | (C) | (a) | 280 | 350 | 0.3 | good | R |
| 7 | (b) | 180 | (D) | (b) | 160 | 110 | 1.2 | good | N |

TABLE 2-continued

| | Plating Conditions and Properties of the Tinplate | | | | | | | | |
|---|---|---|---|---|---|---|---|---|---|
| | Steel Sheet Preheating | | Sn Electroplating Conditions | | | | | | |
| | Atmosphere | Temp. (°C.) | Bath | Atmosphere | Bath Temp. (°C.) | Current Density ($A/dm^2$) | Flow rate (m/sec) | Appearance | Note |
| Comparative Example | | | | | | | | | |
| 1 | (a) | 180 | (A) | (a) | 205 | 200 | 0.4 | uneven | R |
| 2 | (b) | 175 | (B) | (b) | 145 | — | 0 | * | — |
| 3 | (a) | 400 | (C) | (b) | 400 | 300 | 0.6 | grayish black | R,S |
| 4 | — | — | (E) | — | 60 | 100 | 0.3 | burned | N |
| 5 | — | — | (F) | — | 60 | 100 | 0.3 | burned | N |

Note:
N; no-reflow
R; reflow
S; fuming
*; no coatings

As evidenced by the above Examples, it should be apparent that the use of the process of the present invention provides a tinplate having good appearance at high current densities.

EXAMPLE 2

After chemical cleaning (degreasing and acid pickling), a steel sheet was preheated in an atmosphere of the following non-oxidizing gas (a) or (b), and then electroplated in an atmosphere of the same gas in the fused-salt tin electroplating bath for the manufacture of no-reflow type tinplate. The bath composition is given in Table 3.

The bath (A) or (B) was a conventional aqueous tin plating bath containing an aqueous electrolyte solution.

The criterion for judging the suitability of the bath for tin electroplating at high current densities was based on the necessary current density at a voltage of 30 V provided that the power source has a maximum voltage of 30 V and is a conventional source used for most conventional tin electroplating process.

| | |
|---|---|
| Non-oxidizing atmosphere (a): | 95% $N_2$ - 5% $H_2$ |
| Non-oxidizing atmosphere (b): | 100% $N_2$ |
| Halogen Bath (A): | |
| $SnCl_2$ | 50 g/L |
| NaF | 55 g/L |
| $NaHF_2$ | 15 g/L |
| NaCl | 55 g/L |
| A brightener | a proper quantity |
| Ferrostan Bath (B): | |
| $SnSO_4$ | 55 g/L |
| Phenolsulfonic acid (80% solution) | 50 ml/L |
| A brightener | a proper quantity |

TABLE 3 (-1)

| | Plating Conditions and the Appearance of the Coatings | | | | | | | | | | |
|---|---|---|---|---|---|---|---|---|---|---|---|
| | | | Sn Plating Conditions | | | | | | | | |
| | | | | Bath Composition (% by mole) | | | | | | | |
| Examples | Preheating of Steel Sheet | | | | | | | | Temp. | Current Density | Appear- |
| No. | Atmosphere | Temp. (°C.) | Atmosphere | $SnCl_2$ | $AlCl_3$ | NaCl | LiCl | KCl | (°C.) | ($A/dm^2$) | ance |
| 1 | (a) | 180 | (a) | 25 | 50 | 25 | | | 180 | 250 | good |
| 2 | (a) | 200 | (a) | 35 | 45 | 20 | | | 160 | 150 | good |
| 3 | (a) | 180 | (a) | 25 | 45 | 30 | | | 160 | 210 | good |
| 4 | (b) | 180 | (b) | 40 | 45 | 15 | | | 180 | 120 | good |
| 5 | (b) | 190 | (b) | 15 | 60 | 25 | | | 180 | 170 | good |
| 6 | (a) | 180 | (a) | 15 | 50 | | 35 | | 180 | 330 | good |
| 7 | (a) | 150 | (a) | 20 | 50 | | 30 | | 150 | 130 | good |
| 8 | (b) | 180 | (b) | 35 | 45 | | 20 | | 180 | 160 | good |
| 9 | (b) | 200 | (b) | 55 | 30 | | 15 | | 180 | 180 | good |
| 10 | (b) | 180 | (b) | 20 | 65 | | 20 | | 160 | 190 | good |
| 11 | (a)* | 190 | (a) | 25 | 50 | 25 | | | 180 | 250 | good |

*surface-treatment: Ni-diffusion, 0.07 $g/m^2$

TABLE 3 (-2)

| | Plating Conditions and the Appearance of the Coatings | | | | | | | | | | |
|---|---|---|---|---|---|---|---|---|---|---|---|
| | | | Sn Plating Conditions | | | | | | | | |
| | | | | Bath Composition (% by mole) | | | | | | | |
| Com- | | | | | | | | | | Current | |
| parative Examples | Preheating of Steel Sheet | | | | | | | | Temp. | Density | Appear- |
| No. | Atmosphere | Temp. (°C.) | Atmosphere | $SnCl_2$ | $AlCl_3$ | NaCl | LiCl | KCl | (°C.) | ($A/dm^2$) | ance |
| 1 | (a) | 160 | (a) | 10# | 60 | 30 | | | 160 | 50 | uneven |
| 2 | (a) | 190 | (a) | 60# | 25# | 15 | | | 180 | 30 | good |
| 3 | (b) | 150 | (b) | 15 | 75# | 10# | | | 140 | 50 | good |
| 4 | (b) | 170 | (b) | 20 | 30 | 50# | | | 160 | 75 | good |
| 5 | (b) | 160 | (b) | 55 | 35 | | 10# | | 140 | 60 | good |
| 6 | (a) | 180 | (a) | 20 | 30 | | 50# | | 160 | 80 | good |
| 7 | (a) | 190 | (a) | 18 | 65 | 5# | | 12# | 160 | 65 | good |
| 8 | (a) | 100 | (a) | 15 | 50 | | 35 | | 80# | 55 | uneven |
| 9 | (—) | — | | | (A) | | | | 60 | 75 | burned* |

TABLE 3 (-2)-continued

| Comparative Examples No. | Preheating of Steel Sheet Atmosphere | Preheating of Steel Sheet Temp. (°C.) | Plating Conditions and the Appearance of the Coatings: Sn Plating Conditions Atmosphere | Bath Composition (% by mole) $SnCl_2$ | $AlCl_3$ | NaCl | LiCl | KCl | Temp. (°C.) | Current Density ($A/dm^2$) | Appearance |
|---|---|---|---|---|---|---|---|---|---|---|---|
| 10 | (—) | — | | | (B) | | | | 60 | 40 | burned* |

#beyond the scope of the present invention
*coarse surface occurred due to exessive current desnity As evidenced by the above examples, it should be apparent that the use of the process of the present invention provides a tin coatings with good appearance at high current densities and is suitable for use in the high-speed manufacture of tinplates.

EXAMPLE 3

In the equipment such as that shown in FIG. 1, a cold rolling steel strip is coiled round pay-off reel 1 and unwound from the reel 1. The steel strip is pretreated by the use of pretreating apparatus 2 and introduced after drying to annealing furnace 4 in an atmosphere of a non-oxidizing gas (95% $N_2$+5% $H_2$) via sealing device 3. The annealed steel strip is then skin pass rolled by skin pass rolling machine 5 which is housed in the furnace while maintaining at a temperature higher than the plating bath and introduced via sealing device 3 to fused-salt tin-plating bath of plating apparatus 6 in an atmosphere of a non-oxidizing gas. The tin-plated steel strip is introduced to water-rinsing vessel 7 via sealing device 3 to wash off the residue of plating liquid, further aftertreated in aftertreating apparatus 8, coated with oil in oil-coating means 9, and finally reeled around tension reel 10.

EXAMPLE 4

Figure 2:
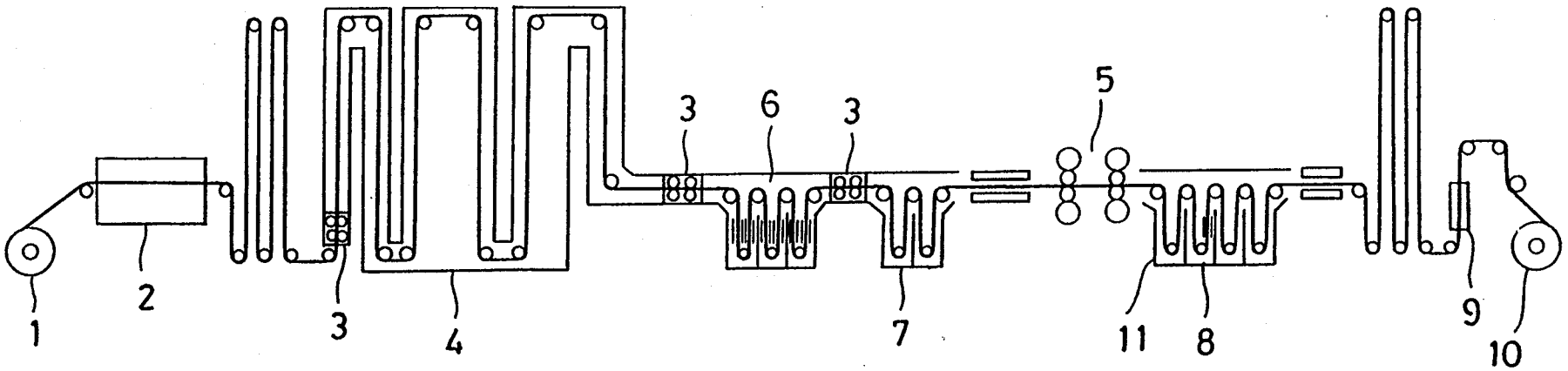
FIG. 2 is another example of equipment for the manufacture of tin-plated steel strip according to the present invention.
Figures 3A, 3B, 3C:
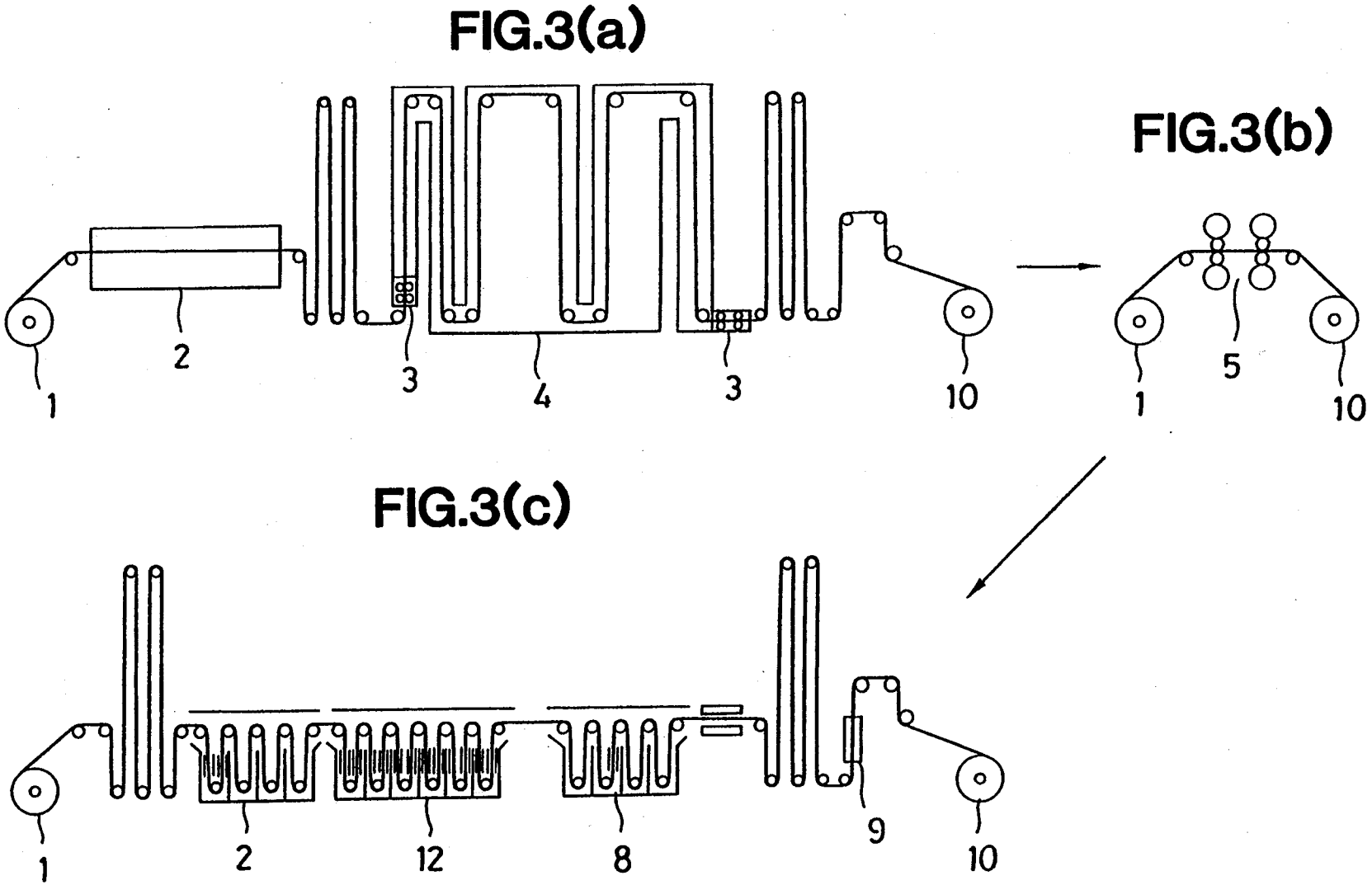
FIG. 3 is a conventional apparatus for the manufacture of the tin-plated steel strip wherein the cold rolling steel sheet is discontinuously and stepwisely treated in the following individual apparatus and order named.

In equipment such as that shown in FIG. 2, the cold rolling steel strip is coiled round pay-off reel 1 and unwound from the reel 1. The steel strip is pretreated by the use of pretreating apparatus 2 and introduced after drying to fused-salt plating bath of plating apparatus 5 in an atmosphere of a non-oxidizing gas (95% $N_2$+5% $H_2$) via sealing device 3. The plated steel strip is further introduced to water-rinsing vessel via sealing device 3 to wash off the residue of plating liquid, then skin pass rolled in skin pass rolling apparatus 5, lightly washed in lightly-cleaning vessel 11, aftertreated in aftertreating vessel 8, finally reeled around tension reel 10 after oil-coating in oil-coating means 9.

What is claimed is:

1. A process for the manufacture of non-reflow tinplate comprising preheating a substrate to be tin-plated at a temperature equal to or higher than the temperature of the tin-plating in an atmosphere of a non-oxidizing gas; and electroplating the preheated substrate in a fused tin-chloride plating bath comprising 15 to 55 mole % of $SnCl_2$, 30 to 70 mole % of $AlCl_3$, and 10 to 40 mole % of NaCl or LiCl at a temperature of 150° to 232° C., and at a current density of 100 to 500 $A/dm^2$ in an atmosphere of a non-oxidizing gas.

2. The process of claim 1 wherein said electroplating is effected while flowing the bath at a flow rate of 0.1 m/sec or higher.

3. The process of claim 1 wherein said substrate is surface treated.

4. The process of claim 1 wherein the substrate is preheated to a temperature higher than the tin-plating temperature by 5° to 30° C.

* * * * *